US011594186B2

(12) United States Patent
Jung et al.

(10) Patent No.: US 11,594,186 B2
(45) Date of Patent: Feb. 28, 2023

(54) DISPLAY DEVICE AND DRIVING CIRCUIT HAVING IMPROVED STABILITY

(71) Applicant: LG Display Co., Ltd., Seoul (KR)

(72) Inventors: Jinhee Jung, Seoul (KR); MooKyoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/525,147

(22) Filed: Nov. 12, 2021

(65) Prior Publication Data

US 2022/0180814 A1 Jun. 9, 2022

(30) Foreign Application Priority Data

Dec. 8, 2020 (KR) ..... 10-2020-0170036

(51) Int. Cl.
*G09G 3/30* (2006.01)
*G09G 3/36* (2006.01)
*G09G 3/3275* (2016.01)

(52) U.S. Cl.
CPC ..... *G09G 3/3275* (2013.01); *G09G 2300/0814* (2013.01); *G09G 2300/0842* (2013.01); *G09G 2310/0291* (2013.01); *G09G 2310/08* (2013.01); *G09G 2330/04* (2013.01); *G09G 2370/10* (2013.01)

(58) Field of Classification Search
CPC ..... G09G 3/3275; G09G 2300/0814; G09G 2310/0291; G09G 2310/08; G09G 2370/10; G09G 2370/14
See application file for complete search history.

(56) References Cited

U.S. PATENT DOCUMENTS

2009/0167750 A1* 7/2009 Hong ..... G09G 3/2096 345/213
2010/0231787 A1* 9/2010 Kim ..... G09G 3/3688 348/503
2015/0187315 A1* 7/2015 Park ..... G09G 5/008 345/99
2019/0141357 A1* 5/2019 Endo ..... G09G 5/026

* cited by examiner

*Primary Examiner* — Sanghyuk Park

(74) *Attorney, Agent, or Firm* — Birch, Stewart, Kolasch & Birch, LLP

(57) ABSTRACT

A display device and a driving circuit are discussed. According to an embodiment of the present disclosure, it is possible to stably maintain the output signal of the driving circuit when the lock signal indicating the synchronization state of the clock signal is changed due to an operation error such as overcurrent in a display device using a point-to-point interface. In addition, according to an embodiment of the present disclosure, it is possible to prevent damage to the display panel due to an overload generated in the output signal of the driving circuit by an operation error. In addition, according to an embodiment of the present disclosure, it is possible to prevent overload of the driving circuit and damage to the display panel by controlling the operation of the driving circuit through a differential input voltage between the timing controller and the driving circuit.

15 Claims, 11 Drawing Sheets

DISPLAY DEVICE AND DRIVING CIRCUIT HAVING IMPROVED STABILITY

CROSS REFERENCE TO RELATED APPLICATION

This application claims priority to Korean Patent Application No. 10-2020-0170036, filed in the Republic of Korea on Dec. 8, 2020, the entire contents of which are hereby incorporated by reference for all purposes as if fully set forth herein into the present application.

TECHNICAL FIELD

The present disclosure relates to a display device and a driving circuit.

BACKGROUND

As the information society develops, the demand for display devices for displaying images is increasing in various forms. Various types of display devices such as a liquid crystal display device (LCD) and an organic light emitting display device (OLED) have been used for this purpose.

Among such display devices, the organic light emitting display device utilizes an organic light emitting diode emitting light by itself, so that there can have advantages in the rapid response speed, contrast ratio, luminous efficiency, luminance and viewing angle.

Such a display device can include light emitting elements disposed in each of a plurality of subpixels arranged on a display panel, so that it is possible to control the luminance displayed in each subpixel and display the image by controlling the voltage or current flowing through the light emitting element to emit light.

Recently, as the resolution increases along with high-speed driving of display devices, the number of subpixels and data lines supplying a data voltage to the subpixels increases, and various signal lines are needed between the driving circuit for driving the display panel and the timing controller controlling the driving circuit.

Accordingly, in order to minimize the number of signal lines placed between the timing controller and the driving circuit and to stabilize signal transmission, there is being researched an interface that serializes digital image data, inserts clock information, converts into a packet unit and transmits a data packet in a point-to-point manner.

In such a point-to-point interface, a lock signal indicating the synchronization state of a clock signal can be transmitted serially between the timing controller and the driving circuit. However, there can cause damage to the display panel due to an overload occurring in the output signal of the driving circuit by an operation error such as overcurrent.

SUMMARY OF THE DISCLOSURE

Embodiments of the present disclosure can provide a display device and a driving circuit capable of stably maintaining the output signal of the driving circuit when the lock signal indicating the synchronization state of the clock signal is changed due to an operation error such as overcurrent in a display device using a point-to-point interface.

Embodiments of the present disclosure can provide a display device and a driving circuit capable of preventing damage to the display panel due to an overload generated in the output signal of the driving circuit by an operation error in a display device using a point-to-point interface.

Embodiments of the present disclosure can provide a display device and a driving circuit capable of preventing overload of the driving circuit and damage to the display panel by controlling the operation of the driving circuit through a differential input voltage between the timing controller and the driving circuit in a display device using a point-to-point interface.

In one aspect, embodiments of the present disclosure can provide a display device including a display panel in which a plurality of data lines and a plurality of subpixels are disposed, a data driving circuit for supplying a data voltage to the plurality of data lines, and a timing controller for controlling the data driving circuit and transmitting a data packet to the data driving circuit through a point-to-point interface, wherein the data driving circuit converts digital image data included in the data packet into the data voltage, and includes a logic circuit for generating a lock output signal according to a differential input voltage of a signal line through which the data packet is transmitted and a lock input signal transmitted from the timing controller.

In one aspect, the data driving circuit can include a plurality of source driving integrated circuits connected in series, wherein the lock input signal is sequentially transmitted through the plurality of source driving integrated circuits, and the data packet is transmitted from the timing controller to the plurality of source driving integrated circuits, respectively.

In one aspect, the data packet can include a clock training pattern for synchronizing an internal clock, a data control signal for controlling the data driving circuit, and the digital image data for displaying an image on the display panel.

In one aspect, the data control signal can include low-level data not including color information.

In one aspect, the data driving circuit can include a clock recovery circuit for generating the internal clock using the data packet and generating a high level lock output signal if a phase of the internal clock is locked, a first logic circuit for receiving an output of the clock recovery circuit and the lock input signal, and a second logic circuit for receiving an output signal of the first logic circuit and the differential input voltage.

In one aspect, the lock output signal can be a signal indicating whether the phase of the internal clock is locked.

In one aspect, the differential input voltage can be determined to be a low level if the differential input voltage is less than or equal to a reference voltage.

In one aspect, the reference voltage can be set by an offset of the second logic circuit.

In one aspect, the data driving circuit can include a receiving buffer for receiving the data packet, a reception characteristic control circuit for controlling reception characteristics of the receiving buffer, an unpacker separating the data packet transmitted through the receiving buffer, a data processing circuit for converting the digital image data of a serial structure separated through the unpacker into a parallel structure, and a phase comparison circuit for comparing the phase of an input clock included in the data packet and a phase of the internal clock.

In one aspect, the data driving circuit can further include a counter for counting the number of transitions of the lock input signal, and a switch for transferring the differential input voltage to the second logic circuit according to an output signal of the counter.

In one aspect, the timing controller can control the differential input voltage corresponding to a maximum voltage level of the data packet.

In one aspect, the timing controller can include a data processing circuit for aligning a clock training pattern, a data control signal and the digital image data into a serial data signal, a clock generation circuit for generating an input clock of the data packet, a packer for embedding the input clock in the serial data signal, a transmission buffer for converting the serial data signal input from the packer into the data packet and transmitting the data packet, and an output characteristic control circuit for controlling output characteristic of the data packet.

In another aspect, embodiments of the present disclosure can provide a driving circuit including a clock recovery circuit for, through a point-to-point interface which serializes digital image data and inserts clock information to transmit a data packet, generating an internal clock using the data packet received during a display driving period, and generating a high level lock output signal when a phase of the internal clock is locked, a first logic circuit for receiving an output of the clock recovery circuit and a lock input signal, and a second logic circuit for receiving an output signal of the first logic circuit and a differential input voltage of a signal line through which the data packet is transmitted.

According to embodiments of the present disclosure, there can provide a display device and a driving circuit capable of stably maintaining the output signal of the driving circuit when the lock signal indicating the synchronization state of the clock signal is changed due to an operation error such as overcurrent in a display device using a point-to-point interface.

According to embodiments of the present disclosure, there can provide a display device and a driving circuit capable of preventing damage to the display panel due to an overload generated in the output signal of the driving circuit by an operation error in a display device using a point-to-point interface.

In addition, according to embodiments of the present disclosure, there can provide a display device and a driving circuit capable of preventing overload of the driving circuit and damage to the display panel by controlling the operation of the driving circuit through a differential input voltage between the timing controller and the driving circuit in a display device using a point-to-point interface.

BRIEF DESCRIPTION OF THE DRAWINGS

The present disclosure will become more fully understood from the detailed description given hereinbelow and the accompanying drawings which are given by way of illustration only, and thus are not limitative of the present disclosure.

DETAILED DESCRIPTION OF THE EMBODIMENTS

Figure 1:
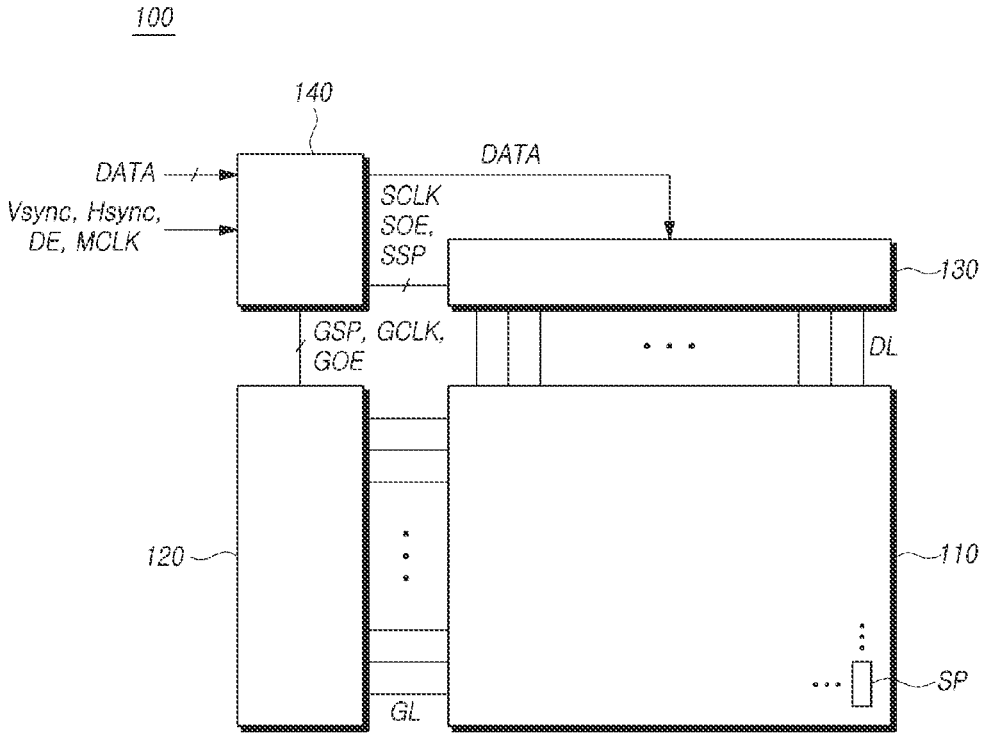
FIG. 1 illustrates a schematic configuration of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description can make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can".

FIG. 1 illustrates a schematic configuration of a display device according to embodiments of the present disclosure. All the components of each display device according to all embodiments of the present disclosure are operatively coupled and configured.

Referring to FIG. 1, a display device 100 according to embodiments of the present disclosure can include a display panel 110 in which a plurality of gate lines GL and data lines DL are connected, and a plurality of subpixels SP are arranged in a matrix form, a gate driving circuit 120 for driving a plurality of gate lines GL, a data driving circuit 130 for supplying a data voltage through a plurality of data lines DL, and a timing controller 140 that controls the gate driving circuit 120 and the data driving circuit 130.

The display panel 110 can display the image based on a scan signal transmitted from the gate driving circuit 120 through a plurality of gate lines GL and a data voltage transmitted from the data driving circuit 130 through a plurality of data lines DL.

In the case of a liquid crystal display (LCD), the display panel 110 includes a liquid crystal layer formed between two substrates, and can be operated in any known mode such as a twisted nematic (TN) mode, a vertical alignment (VA) mode, an in-plane switching (IPS) mode, a fringe field switching (FFS) mode, etc. On the other hand, in the case of an organic light-emitting display (OLED), the display panel 110 can be implemented in a top emission method, a bottom emission method, or a dual emission method.

In the display panel 110, a plurality of pixels can be arranged in a matrix form, and each pixel can composed of a plurality of subpixels SP each having a different color, for example, a white (W) subpixel, a red (R) subpixel, a green (G) subpixel, and a blue (B) subpixels, and each subpixel SP can be defined by a plurality of data lines DL and a plurality of gate lines GL.

One subpixel SP can include a thin film transistor (TFT) formed in a region where one data line DL and one gate line GL intersect, a light emitting element such as an organic light emitting diode (OLED) for charging the data voltage, and a storage capacitor for maintaining a voltage by being electrically connected to the light emitting element.

For example, in the case of the WRGB display device 100 having a resolution of 2,160×3,840, the 2,160 gate lines GL and all 3,840×4=15,360 data lines DL can be provided by 3,840 data lines DL respectively connected to the four subpixels WRGB, and subpixels SP can be disposed at points where these gate lines GL and data lines DL intersect with each other.

The gate driving circuit 120 can be controlled by the timing controller 140, and can sequentially output scan signals to a plurality of gate lines GL disposed on the display panel 110, so aa to control driving timing for a plurality of subpixels SP.

In the display device 100 having a resolution of 2,160×3,840, a case in which scan signals are sequentially output from the first gate line to the 2,160 gate lines for 2,160 gate lines GL can be referred to as 2,160 phase driving. Alternatively, a case in which scan signals are sequentially outputted in units of four gate lines GL, such as a case of sequentially outputting scan signals from the first gate line to the fourth gate line and then sequentially outputting the scan signals from the fifth gate line to the eighth gate line, can be referred to as 4-phase driving. For example, a case in which scan signals are sequentially output for every N gate lines GL can be referred to as N-phase driving.

In this case, the gate driving circuit 120 can include one or more gate driving integrated circuits (GDIC), and can be located on only one side or both sides of the display panel 110 according to a driving method. Alternatively, the gate driving circuit 120 can be embedded in a bezel area of the display panel 110 and implemented in a GIP (Gate-in-panel) form.

The data driving circuit 130 receives digital image data DATA from the timing controller 140, converts the digital image data into an analog data voltage. The data driving circuit 130 then outputs the data voltage to each data line DL according to the timing at which the scan signal is applied through the gate line GL, so that each subpixel SP connected to the data line DL displays a light emission signal of brightness corresponding to the data voltage.

Similarly, The data driving circuit 130 can include one or more source driving integrated circuits (SDIC), and the source driving integrated circuit SDIC can be connected to a bonding pad of the display panel 110 in a TAB (Tape Automated Bonding) method or a COG (Chip-on-glass) method, or can be directly disposed on the display panel 110.

In some cases, each source driving integrated circuit (SDIC) can be integrated and disposed on the display panel 110. In addition, each source driving integrated circuit (SDIC) can be implemented in a COF (Chip-on-film) method. In this case, each source driving integrated circuit (SDIC) can be mounted on a circuit film, and can be electrically connected to the data line DL of the display panel 110.

The timing controller 140 can supply various control signals to the gate driving circuit 120 and the data driving circuit 130 and can control operations of the gate driving circuit 120 and the data driving circuit 130. For example, the timing controller 140 controls the gate driving circuit 120 to output the scan signal according to the timing implemented in each frame, and transfers the digital image data DATA received from the outside to the data driving circuit 130.

In this case, the timing controller 140 can receive various timing signals including a vertical synchronization signal Vsync, a horizontal synchronization signal Hsync, a data enable signal DE, a main clock signal MCLK together with digital image data DATA from an external (e.g., host system). Accordingly, the timing controller 140 can generate a control signal using various timing signals received from the outside, and can transmit the control signal to the gate driving circuit 120 and the data driving circuit 130.

For example, in order to control the gate driving circuit 120, the timing controller 140 can output a plurality of gate control signal including a gate start pulse signal GSP, a gate clock GCLK, and a gate output enable signal GOE. Here, the gate start pulse signal GSP controls the timing at which one or more gate driving integrated circuits (GDIC) constituting the gate driving circuit 120 start to operate. In addition, the gate clock GCLK is a clock signal commonly input to one or more gate driving integrated circuits (GDIC), and controls shift timing of the scan signal. In addition, the gate output enable signal GOE designates timing information of one or more gate driving integrated circuits (GDIC).

In addition, in order to control the data driving circuit 130, the timing controller can output a plurality of data control signals including a source start pulse SSP, a source sampling clock SCLK, and a source output enable signal SOE. Here, the source start pulse SSP controls the timing at which one or more source driving integrated circuits SDIC constituting the data driving circuit 130 start data sampling. The source sampling clock SCLK is a clock signal that controls the timing of sampling data in the source driving integrated circuit SDIC. The source output enable signal SOE controls the output timing of the data driving circuit 130.

Such a display device 100 can further include a power management integrated circuit that supplies various voltages or currents to the display panel 110, the gate driving circuit 120, the data driving circuit 130, or the like, or controls various voltages or currents to be supplied.

Meanwhile, the subpixel SP is located at a region where the gate line GL and the data line DL cross each other, and a light emitting element can be disposed in each subpixel SP. For example, the organic light emitting display device includes a light emitting element such as an organic light emitting diode in each subpixel SP, and can display an image by controlling a current flowing through the light emitting element according to a data voltage.

The display device 100 can be various types of devices such as a liquid crystal display, an organic light emitting display, and a plasma display panel.

Figure 2:
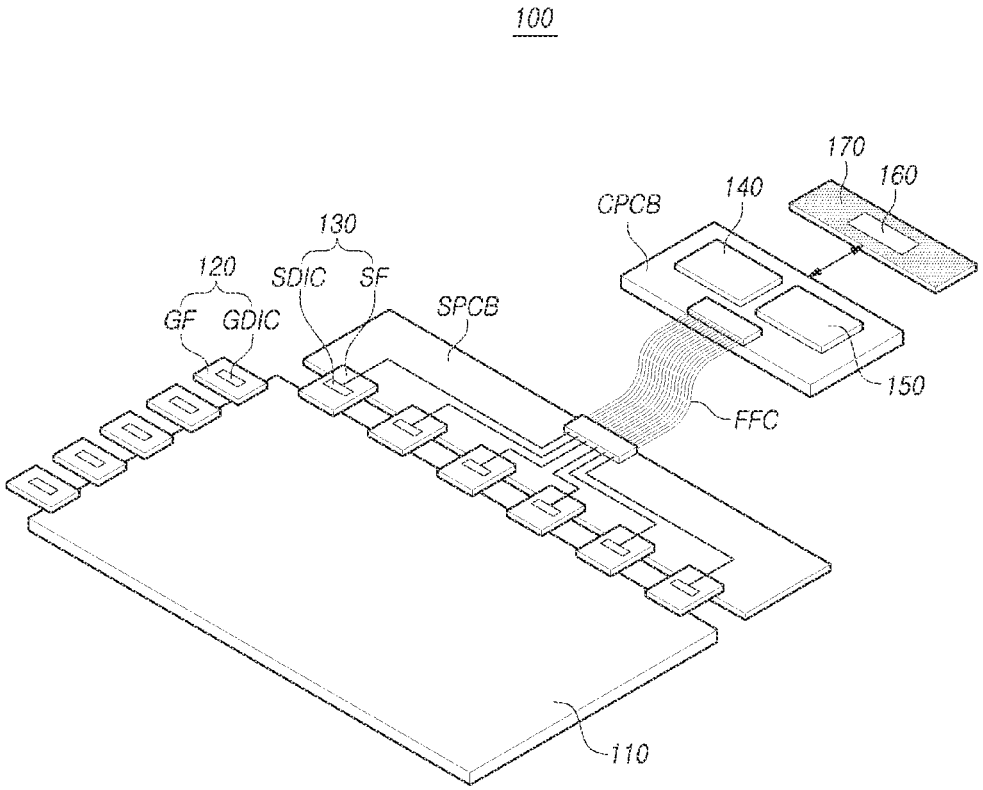
FIG. 2 is an exemplary system diagram of a display device according to embodiments of the present disclosure.

FIG. 2 is an exemplary system diagram of a display device according to embodiments of the present disclosure.

FIG. 2 illustrates the case in which, in the display device 100 according to the exemplary embodiment of the present disclosure, the source driving integrated circuit (SDIC) and the gate driving circuit 120 included in the data driving circuit 130 are implemented in a chip-on-film (COF) method among various methods (TAB, COG, COF, etc.).

At least one gate driving integrated circuit GDIC included in the gate driving circuit 120 can be mounted on the gate film GF, respectively, and one side of the gate film GF can be electrically connected to the display panel 110. Further, lines for electrically connecting the gate driving integrated circuit GDIC and the display panel 110 can be disposed on the gate film GF.

Similarly, at least one source driving integrated circuit SDIC included in the data driving circuit 130 can be mounted on each source film SF, and one side of the source film SF can be electrically connected to the display panel 110. Further, lines for electrically connecting the source driving integrated circuit SDIC and the display panel 110 can be disposed on the source film SF.

The display device 100 can include at least one source printed circuit board SPCB and a control printed circuit board CPCB for mounting control components and various electric devices in order to connect a plurality of source driving integrated circuits SDIC and other devices.

In this case, the other side of the source film SF on which the source driving integrated circuit SDIC is mounted can be connected to the at least one source printed circuit board SPCB. For example, one side of the source film SF on which the source driving integrated circuit SDIC is mounted can be electrically connected to the display panel 110, and the other side thereof can be electrically connected to the source printed circuit board SPCB.

A timing controller 140 and a power management integrated circuit PMIC 150 can be mounted on the control printed circuit board CPCB. The timing controller 140 can control operations of the data driving circuit 130 and the gate driving circuit 120. The power management integrated circuit 150 can supply a driving voltage or current to the display panel 110, the data driving circuit 130, the gate driving circuit 120, and the like, and can control the supplied voltage or current.

At least one source printed circuit board SPCB and a control printed circuit board CPCB can be circuitly or electrically connected through at least one connection member, and the connection member can include, for example, a flexible printed circuit FPC, a flexible flat cable FFC, or the like. In addition, at least one of the source printed circuit board SPCB and the control printed circuit board CPCB can be implemented by being integrated into one printed circuit board.

The display device 100 can further include a set board 170 electrically connected to a control printed circuit board CPCB. In this case, the set board 170 can be referred to as a power board. The set board 170 can include a main power management circuit M-PMC 160 that manages the total power of the display device 100. The main power management circuit 160 can be linked with the power management integrated circuit 150.

In the case of the display device 100 having the above configuration, the driving voltage can be generated at the set board 170 and transmitted to the power management integrated circuit 150 in the control printed circuit board CPCB. The power management integrated circuit 150 can transmit the driving voltage required for driving a display or sensing a characteristic value to a source printed circuit board SPCB through a flexible printed circuit FPC or a flexible flat cable FFC. The driving voltage transmitted to the source printed circuit board SPCB can be supplied to emit or sense a specific subpixel SP in the display panel 110 through the source driving integrated circuit SDIC.

In this case, each of the subpixels SP arranged on the display panel 110 in the display device 100 can include an organic light emitting diode, which is a light emitting element, and a circuit element such as a driving transistor for driving the subpixel SP.

The type and number of circuit elements constituting each subpixel SP can be variously determined according to a provision function and a design method.

The display device of the present disclosure can use a point-to-point interface which serializes digital image data DATA, inserts clock information to convert into and transmit packet units, in order to minimize the number of signal lines connecting the timing controller 140 mounted on the control printed circuit board (CPCB) and the data driving circuit 130 mounted on the source printed circuit board (SPCB) and to stabilize signal transmission.

Figure 3:
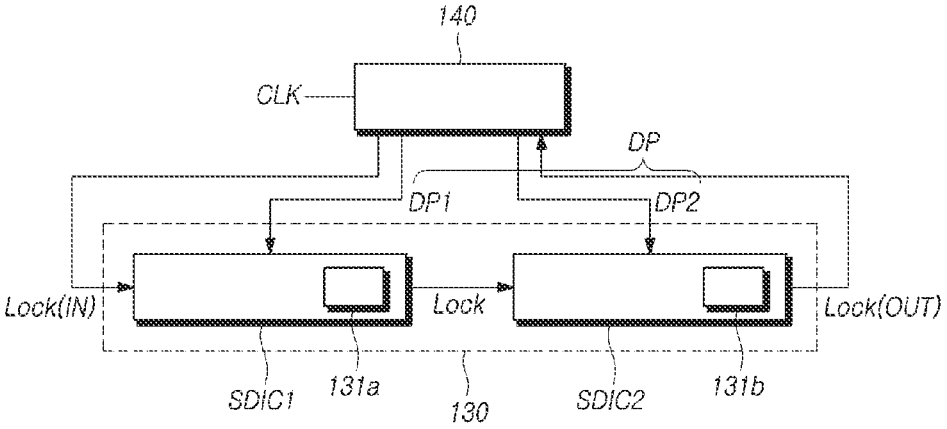
FIG. 3 illustrates an exemplary structure of a point-to-point interface in a display device according to embodiments of the present disclosure.
Figure 4:
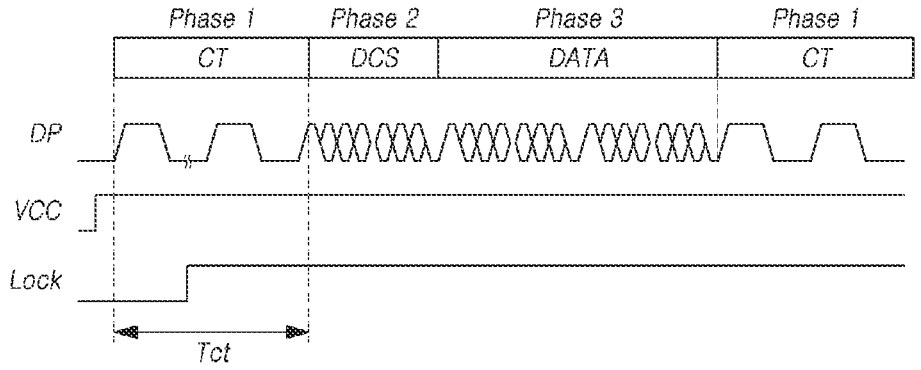
FIG. 4 illustrates an example of a waveform of a signal transmitted from a point-to-point interface in a display device according to embodiments of the present disclosure.

FIG. 3 illustrates an exemplary structure of a point-to-point interface in a display device according to embodiments of the present disclosure, and FIG. 4 illustrates an example of a waveform of a signal transmitted through a point-to-point interface in a display device according to embodiments of the present disclosure.

Referring to FIG. 3 and FIG. 4, a display device 100 according to embodiments of the present disclosure can include a timing controller 140 for transmitting a plurality of data packets DP and a data driving circuit 130 for receiving a plurality of data packets DP transmitted from the timing controller 140.

The interface standard exemplified here is an embedded point-to-point interface (EPI) which serializes data control signal DCS and digital image data DATA, inserts clock information, converts it into packet units, and transmits data packets DP, in order to reduce the number of data transmission lines between the timing controller 140 and the data driving circuit 130 and to perform high-speed transmission.

Here, it is exemplary described a structure in which the timing controller 140 transmits the data packet DP, receives the data packets DP1 and DP2 from the data driving circuit 130 including two source driving integrated circuits SDIC1, SDIC2, respectively, and supplies the data packets DP1, DP2 to the display panel 110.

The timing controller 140 can transmit the data packets DP1, DP2 to the corresponding data driving circuit 130 according to a clock signal CLK, respectively.

In this case, the data packet DP transmitted by the timing controller 140 can be divided into a first transmission period, a second transmission period, and a third transmission period.

In the first transmission period, clock training for synchronizing the clock signal CLK can be performed using the clock training pattern CT. In the second transmission period, a data control signal DCS for controlling the data driving circuit 130 can be transmitted, and image data DATA can be transmitted in the third transmission period. However, the section in which the data packet DP is transmitted and the type of transmitted data can be expressed in various ways.

In a horizontal blank time or a vertical blank time, the timing controller 140 can synchronize the clock signal CLK by performing clock training with the data driving circuit 130 during the clock training time Tct.

The timing controller 140 can transmit a lock input signal Lock(IN) to the data driving circuit 130 while being synchronized with the data driving circuit 130 through clock training. In addition, the timing controller 140 can receive feedback of the lock output signal Lock(OUT) from the data driving circuit 130.

If the phase of an internal clock signal is locked, the first source driving integrated circuit SDIC1 can generate a lock signal of a high logic level indicating a stable state of the output and transmit to the adjacent second source driving integrated circuit SDIC2.

In this case, the lock signal Lock generated by the last source driving integrated circuit (SDIC2 in this case) of the data driving circuit 130 can be the lock output signal Lock(OUT) of the data driving circuit 130, and the lock output signal Lock(OUT) can be transmitted to the timing controller 140 through a signal lines connected between the timing controller 140 and the last source driving integrated circuit SDIC2. In this case, a high-level DC power supply voltage VCC is input to the lock signal (Lock(IN), Lock) input terminals of the source driving integrated circuits SDIC1, SDIC2.

In the case that a normal lock output signal Lock(OUT) is received through the data driving circuit 130, the timing controller 140 can transmit data packets DP1, DP2 corresponding to a plurality of source driving integrated circuits SDIC1, SDIC2 constituting the data driving circuit 130.

In this case, the embedded point-to-point interface (EPI) standard may not use a line for transmitting the clock signal CLK between the timing controller 140 and the data driving circuit 130 in order to reduce the transmission line. In this case, when the timing controller 140 transmits the data packet DP, the data driving circuit 130 can generate an internal clock signal in a clock recovery circuits 131*a*, 131*b* using the received data packet DP, and transmit digital image data DATA in response to the generated internal clock signal.

In this case, the data driving circuit 130 can compare the internal clock signal generated by the clock recovery circuits 131*a*, 131*b* with the clock training pattern transmitted from the timing controller 140, and can generate a high level lock signal Lock or transmit a high level lock output signal Lock(OUT) to the timing controller 140 if there is no abnormality as a result of the comparison.

Meanwhile, the lock output signal Lock(OUT) transmitted from the data driving circuit 130 to the timing controller 140 can be a signal obtained by feeding back a lock input signal Lock(IN) transmitted from the timing controller 140 to the data driving circuit 130.

In a state in which the lock output signal Lock(OUT) is transmitted to the timing controller 140, the data driving circuit 130 can lock or fix the phase and frequency of the synchronized data packet DP through clock training. Therefore, there can be in a state capable of receiving the data packet DP transmitted from the timing controller 140.

In this case, if a point-to-point interface is used, the timing controller 140 can control an output characteristic of the transmitted data packet DP according to a connection state with the data driving circuit 130 or a signal transmission characteristic.

Meanwhile, in the case of a display device 100 using the point-to-point interface, there can occur a phenomenon in which the lock signal indicating the stable state of an internal clock signal is toggled in the form of a pulse due to an operation error such as overcurrent. Accordingly, in the case that the lock signal Lock is irregularly changed, it is necessary to stably maintain the data voltage Vdata applied from the data driving circuit 130 to the display panel 110.

Figure 5:
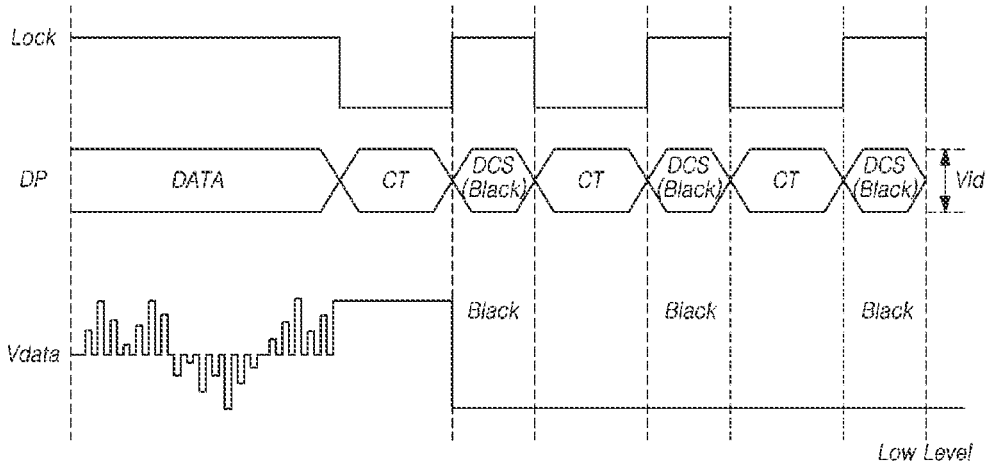
FIG. 5 illustrates a waveform of an interface signal for stably maintaining an output of a data driving circuit when a lock signal is irregularly changed in a display device according to embodiments of the present disclosure.

FIG. 5 illustrates a waveform of an interface signal for stably maintaining an output of a data driving circuit when a lock signal is irregularly changed in a display device according to embodiments of the present disclosure.

Referring to FIG. 5, in a display device according to embodiments of the present disclosure, a data driving circuit 130 can compare an internal clock signal generated from the data packet DP transmitted from the timing controller 140 with the clock training pattern transmitted from the timing controller 140, and, if there is no abnormality, can generate a high level lock signal Lock.

If the high level lock signal Lock is received, the timing controller 140 can transmit the digital image data DATA to the data driving circuit 130, and the data driving circuit 130 can convert the digital image data DATA into an analog data voltage Vdata and transmit to the display panel 110.

In this case, in the lock signal Lock transmitted through the data driving circuit 130, there can occur a toggle phenomenon that alternately transitions between a high level and a low level due to an overcurrent being applied, noise inflow, or operation error.

As described above, if the lock signal Lock toggles between the high level and the low level, the timing controller 140 transmits the clock training pattern CT in a section of the low level of the lock signal Lock, but transmits the data control signal DCS in a section of the high level of the lock signal Lock.

In this case, while the clock training pattern CT is transmitted from the timing controller 140 by the low level lock signal Lock, the data driving circuit 130 does not receive the digital image data DATA. Therefore, the data voltage Vdata in the previous section is maintained.

In a state in which the lock signal Lock transitions to a high level after clock training, the timing controller 140 transmits the data control signal DCS to the data driving circuit 130. In this case, the data control signal DCS can include low level data that does not include information on colors (e.g., red (R), green (G), and blue (B)) of an image displayed on the display panel 110. For example, low level data included in the data control signal DCS can be black grayscale data for improving motion picture response time (MPRT) of an image displayed on the display panel 110.

Accordingly, even when the lock signal Lock transitions to the low level, since the data voltage Vdata is at the low level in the previous section, the data voltage Vdata maintains the low level in the subsequent section.

Accordingly, in the case that the lock signal Lock is toggled due to overcurrent or the like, the data voltage Vdata of the data driving circuit 130 can be maintained at a low level by using the black data included in the data control signal DCS. Accordingly, it is possible to prevent overvoltage from being applied to the display panel 110 and to reduce the occurrence of defects.

In this case, the data packet DP transmitted from the timing controller 140 to the data driving circuit 130 has the magnitude of the differential input voltage Vid transmitted through the paired signal line.

Meanwhile, in the case that some sections of the paired signal lines are short-circuited, the magnitude of the differential input voltage Vid can be reduced to a voltage close to zero, and thus, there can be a case in which the data voltage Vdata transferred from the data driving circuit 130 to the display panel 110 has an abnormally high voltage.

Figure 6:
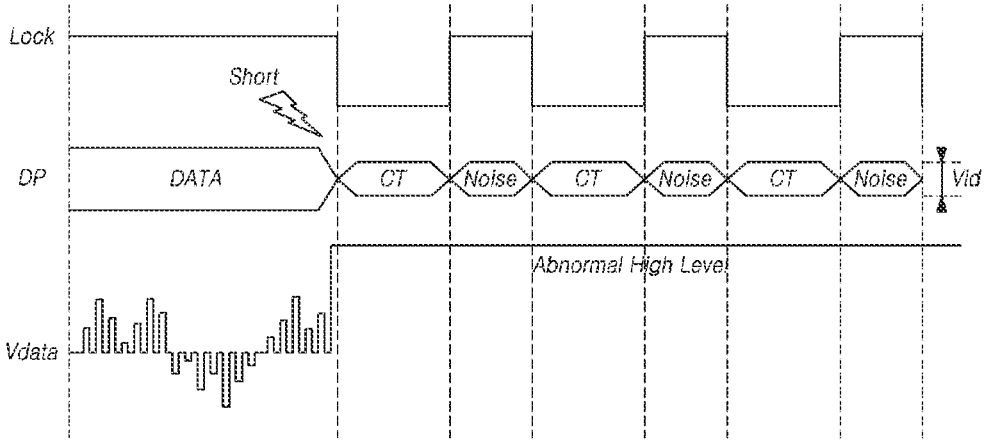
FIG. 6 illustrates an example of a case in which a data voltage is output as an abnormal high voltage due to a short-circuit failure in a signal line transmitting a data packet in a display device according to embodiments of the present disclosure.

FIG. 6 illustrates an example of a case in which a data voltage is output as an abnormal high voltage due to a short-circuit failure in a signal line transmitting a data packet in a display device according to embodiments of the present disclosure.

Referring to FIG. 6, in a display device according to embodiments of the present disclosure, if a short circuit failure occurs in the signal line transmitting the data packet DP, the differential input voltage Vid formed between the paired signal lines can have a small magnitude close to zero.

Accordingly, in a state in which the lock signal Lock transmitted through the data driving circuit 130 is toggled between a high level and a low level due to an overcurrent or the like, since the data driving circuit 130 may not receive the digital image data DATA during the period in which the clock training pattern CT is transmitted from the timing controller 140 by the low-level lock signal Lock, the data driving circuit 130 can maintain the data voltage Vdata in the previous section.

However, the data control signal DCS is not transmitted from the timing controller 140 due to a short circuit failure of the signal line in a state in which the lock signal Lock is transitioned to a high level after clock training, and noise signal can be transmitted to the data driving circuit 130 through the shorted signal line.

Accordingly, the data driving circuit 130 does not transition the data voltage Vdata to the low level, and continues to maintain the level of the data voltage Vdata in the previous section.

As a result, the data driving circuit 130 continuously supplies the data voltage Vdata of an abnormal high level to the display panel 110, thus causing the damage of the data line DL or a defect in the display panel 110.

Therefore, in the case that the differential input voltage Vid is generated at a low voltage due to a short circuit failure in the signal line for transmitting the data packet DP, it can be possible to control the data voltage Vdata of an abnormal level not to be generated by transitioning the lock signal Lock to a low level.

Figure 7:
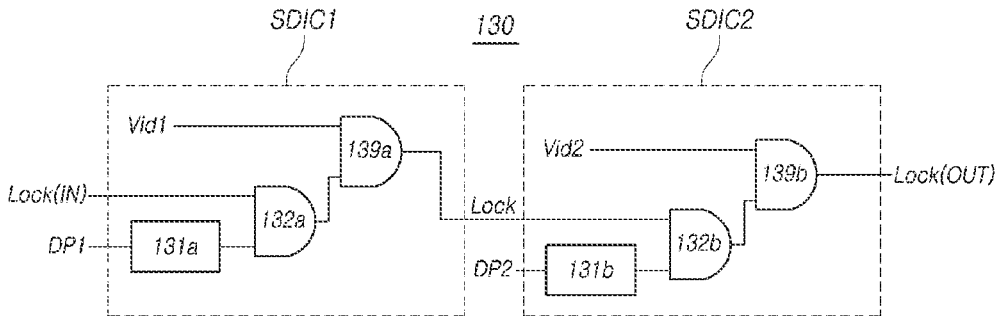
FIG. 7 illustrates an example of a data driving circuit for a point-to-point interface operation in a display device according to embodiments of the present disclosure.

FIG. 7 illustrates an example of a data driving circuit for a point-to-point interface operation in a display device according to embodiments of the present disclosure.

Here, it is illustrated a case in which the data driving circuit 130 is composed of two source driving integrated circuits SDIC1, SDIC2 as an example.

Referring to FIG. 7, in a display device according to embodiments of the present disclosure, the data driving circuit 130 for the point-to-point interface operation can include a plurality of source driving integrated circuits SDIC1, SDIC2 that sequentially transmit the lock input signal Lock(IN) transmitted from the timing controller 140. In this case, the plurality of source driving integrated circuits SDIC1, SDIC2 receive data packets DP1, DP2 from the timing controller 140, respectively.

Each of the plurality of source driving integrated circuits SDIC1, SDIC2 can include a clock recovery circuits 131*a*, 131*b* and logic circuits 132*a*, 139*a*, and 132*b*, 139*b*, respectively.

Here, the logic circuits 132*a*, 132*b*, 139*a*, 139*b* include first logic circuits 132*a*, 132*b* and second logic circuits 139*a*, 139*b*. The first logic circuits 132*a*, 132*b* can receive the outputs of the clock recovery circuits 131*a*, 131*b* and the lock signals Lock(IN) and Lock, and the second logic circuits 139*a*, 139*b* can generate high level or low level output signals Lock and Lock(OUT)) according to the output of the first logic circuits 132*a*, 132*b* and the differential input voltages Vid1, Vid2, respectively.

Here, it is illustrated the case where the logic circuits 132*a*, 132*b*, 139*a*, 139*b* are formed of AND gates as an example. However, the logic circuits 132*a*, 132*b*, 139*a*, 139*b* can be modified to various structures capable of changing the level of the output according to the output of the clock recovery circuits 131*a*, 131*b*, the lock signals Lock(IN), Lock, and the differential input voltages Vid1, Vid2.

Specifically, the clock recovery circuit 131*a* of the first source driving integrated circuit SDIC1 can generate an internal clock signal by using the data packet DP1 transmitted from the timing controller 140 during the display driving period, and, if the internal clock signal is normally generated, can transfer a high level logic signal to the first logic circuit 132*a*.

The first logic circuit 132*a* of the first source driving integrated circuit SDIC1 can receive the output signal of the clock recovery circuit 131*a* and the lock input signal Lock (IN) transmitted from the timing controller 140. If the internal clock signal is normally generated and the high level lock input signal Lock(IN) is input from the timing controller 140, the first logic circuit 132*a* can transmit the high level output signal to the second logic circuit 139*a*.

The second logic circuit 139*a* can generate a high level lock signal Lock if the differential input voltage Vid1 of the signal line transmitting the data packet DP1 is applied to a high level greater than or equal to a reference voltage, and can transmit the high level lock signal Lock to the second source driving integrated circuit SDIC2.

On the other hand, in the case that a defect such as a short circuit occurs in the signal line transmitting the data packet DP1, the differential input voltage Vid1 of the signal line transmitting the data packet DP1 can be applied at a low level less than the reference voltage. In this case, the second logic circuit 139*a* generates the low level lock signal Lock, thereby preventing the abnormal data voltage Vdata from being generated in the first source driving integrated circuit SDIC1.

The clock recovery circuit 131*b* of the second source driving integrated circuit SDIC2 can generate an internal clock signal using the data packet DP2 transmitted from the timing controller 140 during the display driving period, and, if the internal clock signal is normally generated, can transfer a high level logic signal to the first logic circuit 132*b*.

The first logic circuit 132*a* of the second source driving integrated circuit SDIC2 can receive the output signal of the clock recovery circuit 131*b* and the lock input signal Lock transmitted from the first source driving integrated circuit SDIC1. If the internal clock signal is normally generated and the high level lock signal Lock is input from the first source driving integrated circuit SDIC1, the first logic circuit 132*b* can transmit the high level output logic to the second logic circuit 139*b*.

In the case that the differential input voltage Vid2 of the signal line transmitting the data packet DP2 is applied at a high level greater than or equal to the reference voltage, the second logic circuit 139*b* can generate a high level lock output signal Lock(OUT) and transmit it to the timing controller 140.

If a defect such as a short circuit occurs in the signal line transmitting the data packet DP2, the differential input voltage Vid1 of the signal line transmitting the data packet DP2 can be applied at a low level equal to or less than the reference voltage. In this case, the second logic circuit 139*b* can generate the low level lock output signal Lock(OUT), thereby preventing the abnormal data voltage Vdata from being generated in the second source driving integrated circuit SDIC2.

In this case, the reference voltage for determining the differential input voltages Vid1 and Vid2 as a high level or a low level can be changed by adjusting an offset of the second logic circuits 139*a*, 139*b*.

Figure 8:
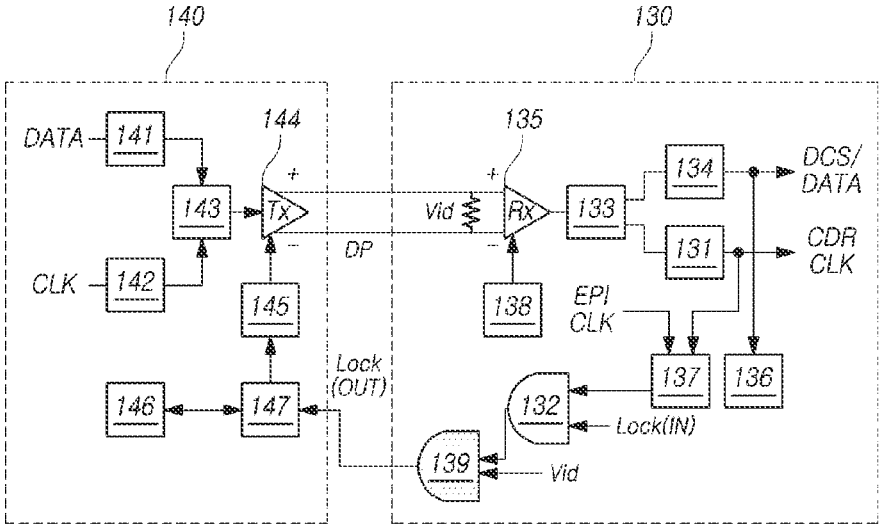
FIG. 8 is a block diagram specifically illustrating internal configurations of a timing controller and a data driving circuit in a display device according to embodiments of the present disclosure.

FIG. 8 is a block diagram specifically illustrating internal configurations of a timing controller and a data driving circuit in a display device according to embodiments of the present disclosure.

Here, it is illustrated by assuming that one source driving integrated circuit SDIC is disposed in the data driving circuit 130 to directly exchange signals with the timing controller 140. However, as described above, a plurality of source driving integrated circuits SDIC can be located in the data driving circuit 130, and in this case, the plurality of source driving integrated circuits SDIC can have the same circuit configuration.

Referring to FIG. 8, in a display device according to embodiments of the present disclosure, the timing controller 140 can include a data processing circuit 141, a clock generation circuit 142, a packer 143, a transmission buffer 144, an output characteristic changing circuit 145, an output characteristic control circuit 147 and a memory 146.

The data processing circuit 141 can align the clock training pattern CT, the data control signal DCS and the digital image data DATA in a serial data bit stream, and supply it to the packer 143.

The clock generation circuit 142 can supply the bits of the input clock EPI CLK to the packer 143.

The packer 143 can embed the bits of the input clock EPI CLK in the serial data signal to satisfy the signal transmission protocol of the point-to-point interface, and can supply it to the transmission buffer 144.

The transmission buffer 144 can convert the serial data signal input from the packer 143 into a data packet DP of a differential signal, and can transmit it to the data driving circuit 130 through a paired signal line.

In this case, the output characteristic changing circuit 145 can change output characteristics such as the differential input voltage Vid and the pre-emphasis PE. For example, the output characteristic changing circuit 145 can vary the differential input voltage Vid and the pre-emphasis PE by adjusting the driving voltage or the gain of the transmission buffer 144.

For this, the output characteristic control circuit 147 can control the output characteristic changing circuit 145 to change the output characteristic values for the differential input voltage Vid and the pre-emphasis PE according to a predetermined reference.

The data driving circuit 130 or the source driving integrated circuit SDIC can include a receiving buffer 135, a reception characteristic control circuit 138, an unpacker 133, a data processing circuit 134, a clock recovery circuit 131, an error detection circuit 136, a phase comparison circuit 137, and logic circuits 132 and 139.

The receiving buffer 135 receives the data packet DP through the paired signal line and supplies it to the unpacker 133. The reception characteristic control circuit 138 can vary reception characteristics such as equalizing EQ and reception resistance of a reception resistor R according to the output characteristics received from the timing controller 140 in order to control reception characteristics of the data driving circuit 130.

For example, the reception characteristic control circuit 138 can vary or change the equalizing EQ level by adjusting the gain of the receiving buffer 135 according to the equalizing EQ setting value. The data packet DP received from the timing controller 140 can be amplified according to the equalizing EQ level set by the reception characteristic control circuit 138.

The reception resistor R can be connected between both input terminals of the receiving buffer 135 in the data driving circuit 130, and can be implemented as a variable resistor whose resistance value is selected according to the selection signal of the reception characteristic control circuit 138. The reception characteristic control circuit 138 can change the amplitude of the data packet DP by varying the reception resistance of the reception resistor R according to the output characteristic received from the timing controller 140.

The unpacker 133 separates the clock training pattern CT, the data control signal DCS, and the digital image data DATA from the data packet DP received through the receiving buffer 135.

Then, the unpacker 133 transmits the input clock EPI CLK included in the clock training pattern CT to the clock recovery circuit 131, and transmits the data control signal DCS and the digital image data DATA to the data processing circuit 134.

The data processing circuit 134 converts digital image data DATA of a serial structure into data of a parallel structure using a shift register and a latch. In this case, the shift register and the latch of the data processing circuit 134 can be synchronized according to the internal clock CDR CLK generated by the clock recovery circuit 131.

The clock recovery circuit 131 generates the internal clock CDR CLK according to the clock training pattern CT received from the unpacker 133, and can control the phase of the internal clock CDR CLK to be synchronized with the input clock EPI CLK.

In this case, if the phase of the internal clock CDR CLK coincides with the phase of the input clock EPI CLK, the clock recovery circuit 131 can lock or fix the phase of the internal clock CDR CLK.

The phase comparison circuit 137 compares the phase of the input clock EPI CLK included in the data packet DP with the phase of the internal clock CDR CLK generated by the clock recovery circuit 131, and generate a high level output signal if the phases are the same.

On the other hand, if the phase of the input clock EPI CLK and the phase of the internal clock CDR CLK are not the same, the phase comparison circuit 137 generates a low level output signal.

If a high level output signal is input from the phase comparison circuit 137 and a high level lock input signal Lock(IN) is input from the timing controller 140, the first logic circuit 132 transmits a high level logic signal to the second logic circuit 139.

The second logic circuit 139 receives the differential input voltage Vid formed at both ends of the reception resistor R and the output signal of the first logic circuit 132, and can transmit the high level lock output signal Lock(OUT) to the timing controller 140 only when the differential input voltage Vid is applied with a high level greater than or equal to the reference voltage. On the other hand, in the case that the differential input voltage Vid is applied at a low level equal to or less than the reference voltage, the second logic circuit 139 can transmit the low level lock output signal Lock (OUT) to the timing controller 140, thereby preventing an abnormal data voltage Vdata from being output from the data driving circuit 130.

In the case that the plurality of source driving integrated circuits SDIC are disposed in the data driving circuit 130, the lock input signal Lock(IN) input to the first logic circuit 132 can be a lock signal Lock transmitted from an adjacent source driving integrated circuit SDIC.

The error detection circuit 136 can check whether there is an error in the digital image data DATA output through the data processing circuit 134.

Figure 9:
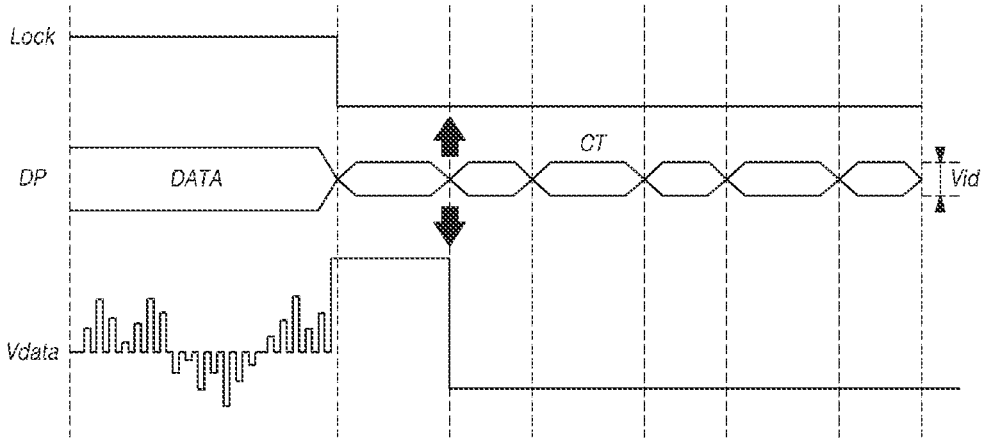
FIG. 9 illustrates an example of preventing a defect by blocking a data voltage when a signal line transmitting a data packet is short-circuited in a display device according to embodiments of the present disclosure.

FIG. 9 illustrates an example of preventing a defect by blocking a data voltage when a signal line transmitting a data packet is short-circuited in a display device according to embodiments of the present disclosure.

Referring to FIG. 9, in a display device according to embodiments of the present disclosure, if a short circuit failure occurs in the signal line transmitting the data packet DP, the differential input voltage Vid formed between the paired signal lines can have a small magnitude close to zero.

In a state in which the lock signal Lock transmitted through the data driving circuit 130 is toggled between the high level and the low level due to overcurrent or the like, since the data driving circuit 130 may not receive the digital image data DATA during the period in which the clock training pattern CT is transmitted from the timing controller 140 by the low level lock signal Lock, the data voltage Vdata in the previous section can be maintained.

As described above, since the differential input voltage Vid of the signal line transmitting the data packet DP is maintained at a low level below the reference voltage when a defect such as a short circuit fault occurs in the signal line transmitting the data packet DP, the second logic circuit 139 receiving the differential input signal Vid as an input can generate a low level lock signal Lock, thereby preventing an abnormal data voltage Vdata from being generated in the data driving circuit 130.

For example, in the display device 100 of the present disclosure, in the case that the differential input voltage Vid is generated at a low voltage due to a short-circuit fault in the signal line transmitting the data packet DP, it is possible to control the data driving circuit 130 not to generate an abnormal level of the data voltage Vdata by transitioning the lock signal Lock to the low level.

Meanwhile, the reference voltage for determining the level of the differential input voltage Vid can be changed by adjusting an offset of the second logic circuit 139 to which the differential input voltage Vid is applied, or can be changed, by the timing controller 140, by controlling the maximum voltage level between the positive voltage (+) and the negative voltage (−) of the differential input voltage Vid for the data packet DP.

Figure 10:
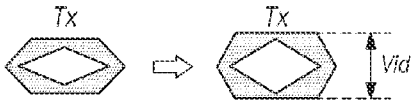
FIG. 10 is an exemplary diagram illustrating an eye diagram according to an output characteristic of a differential input voltage in a display device according to embodiments of the present disclosure.

FIG. 10 is an exemplary diagram illustrating an eye diagram according to an output characteristic of a differential input voltage in a display device according to embodiments of the present disclosure.

Referring to FIG. 10, in a display device according to embodiments of the present disclosure, the eye diagram can be used as an index indicating signal quality affected by analog characteristics of digital image data DATA including, for example, amplitude, slew rate of rise or falling time, DC level, jitter, etc.

Here, the differential input voltage Vid represents the maximum voltage of the data packet DP output from the transmission buffer 144 of the timing controller 140, for example, the maximum voltage level between the positive voltage (+) and the negative voltage (−) of the differential input voltage Vid.

Accordingly, in order to effectively determine whether a defect such as a short circuit failure or the like occurs in the signal line transmitting the data packet DP, the differential input voltage Vid can be increased or decreased.

Meanwhile, the point-to-point interface according to the present disclosure can be configured to control the lock signal Lock according to the differential input voltage Vid only when the lock signal Lock is toggled more than a specific number of times within a specific time interval due to overcurrent or the like.

Figure 11:
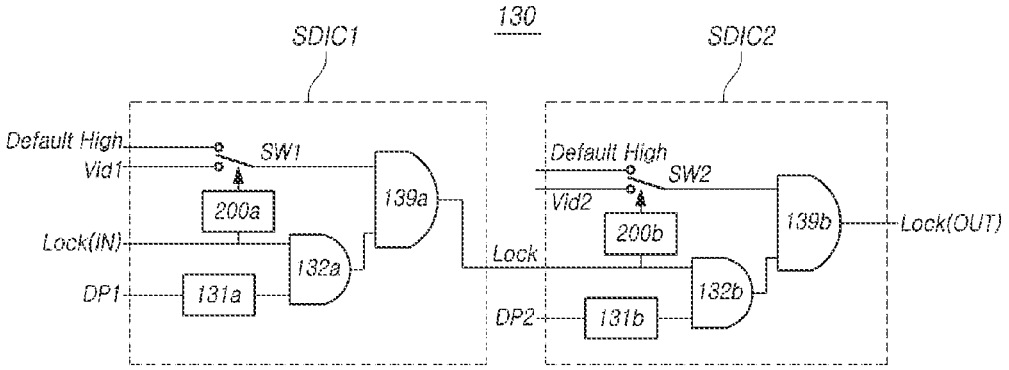
FIG. 11 illustrates another example of a data driving circuit for a point-to-point interface operation in a display device according to embodiments of the present disclosure.

FIG. 11 illustrates another example of a data driving circuit for a point-to-point interface operation in a display device according to embodiments of the present disclosure.

Here, it is illustrated a case in which the data driving circuit 130 is composed of two source driving integrated circuits SDIC1 and SDIC2 as an example.

Referring to FIG. 11, in a display device according to embodiments of the present disclosure, the data driving circuit 130 for the point-to-point interface operation can include a plurality of source driving integrated circuits SDIC1 and SDIC2 that sequentially transmit the lock input signal Lock(IN) transmitted from the timing controller 140. In this case, the plurality of source driving integrated circuits SDIC1, SDIC2 receive data packets DP1, DP2 from the timing controller 140, respectively.

Each of the plurality of source driving integrated circuits SDIC1, SDIC2 can include a clock recovery circuit 131*a*, 131*b*, a logic circuit 132*a*, 139*a*, and 132*b*, 139*b*, and counters 200*a*, 200*b*, respectively.

Here, the logic circuits 132*a*, 132*b*, 139*a*, 139*b* include first logic circuits 132*a*, 132*b* and second logic circuits 139*a*, 139*b*. The first logic circuits 132*a*, 132*b* receive the outputs of the clock recovery circuits 131*a*, 131*b* and the lock signals Lock(IN), Lock, and the second logic circuits 139*a*, 139*b* can generate high level or low level output signals Lock and Lock(OUT) according to the output of the first logic circuits 132*a*, 132*b* and the differential input voltages Vid1, Vid2, respectively.

Here, it is illustrated the case where the logic circuits 132*a*, 132*b*, 139*a*, 139*b* are formed of AND gates as an example. However, the logic circuits 132*a*, 132*b*, 139*a*, 139*b* can be modified to various structures capable of changing the level of the output according to the output of the clock recovery circuits 131*a*, 131*b*, the lock signals Lock(IN), Lock, and the differential input voltages Vid1, Vid2.

Specifically, the clock recovery circuit 131*a* of the first source driving integrated circuit SDIC1 can generate an internal clock signal by using the data packet DP1 transmitted from the timing controller 140 during the display driving period, and, if the internal clock signal is normally generated, can transfer a high level logic signal to the first logic circuit 132*a*.

The first logic circuit 132*a* of the first source driving integrated circuit SDIC1 can receive the output signal of the clock recovery circuit 131*a* and the lock input signal Lock (IN) transmitted from the timing controller 140. If the internal clock signal is normally generated and the high level lock input signal Lock(IN) is input from the timing controller 140, the first logic circuit 132*a* can transmit the high level output signal to the second logic circuit 139*a*.

Meanwhile, the counter 200*a* counts the number of times the lock input signal Lock(IN) transitions to the high level and the low level, and controls the switch SW1 so that the differential input voltage Vid1 or the default high value is applied to the second logic circuit 139*a* according to the result value.

For example, in the case that the lock input signal Lock(IN) provided by the timing controller 140 fails to maintain the high level state due to overcurrent or the like and transitions between the high level and the low level more than a certain number of times, the counter 200*a* can detect this and control the switch SW1 so that the differential input voltage Vid1 is transmitted to the second logic circuit 139*a*. On the other hand, if the lock input signal Lock(IN) normally maintains a high state, the lock signal Lock can be generated according to the output value of the first logic circuit 132*a* by applying the default high signal to the second logic circuit 139*a*.

Accordingly, in a state in which the differential input voltage Vid1 is applied to the second logic circuit 139*a*, if the differential input voltage Vid1 is applied in a normal high level state, the second logic circuit 139*a* can generate a high level lock signal Lock and transmit it to the second source driving integrated circuit SDIC2.

On the other hand, in a state in which the differential input voltage Vid1 is applied to the second logic circuit 139*a*, if the differential input voltage Vid1 is applied at a low level equal to or less than the reference voltage due to a defect such as a short circuit, the second logic circuit 139*a* can generate a low level lock signal Lock, thereby blocking the transmission of the digital image data DATA from the timing controller 140 and preventing an abnormal data voltage Vdata from being generated in the first source driving integrated circuit SDIC1.

The clock recovery circuit 131*b* of the second source driving integrated circuit SDIC2 can generate an internal clock signal using the data packet DP2 transmitted from the timing controller 140 during the display driving period, and, if the internal clock signal is normally generated, can transfer a high level logic signal to the first logic circuit 132*b*.

The first logic circuit 132*a* of the second source driving integrated circuit SDIC2 can receive the output signal of the clock recovery circuit 131*b* and the lock input signal Lock transmitted from the first source driving integrated circuit SDIC1. If the internal clock signal is normally generated and the high level lock signal Lock is input from the first source driving integrated circuit SDIC1, the first logic circuit 132*b* can transmit the high level output logic to the second logic circuit 139*b*.

Meanwhile, the counter 200*b* counts the number of times the lock signal Lock transitions to the high level and the low level, and controls the switch SW2 so that the differential input voltage Vid2 or the default high value is applied to the second logic circuit 139*b* according to the result value.

For example, in the case that the lock signal Lock provided by the first source driving integrated circuit SDIC1 fails to maintain the high level state due to overcurrent or the like and transitions between the high level and the low level more than a certain number of times, the counter 200*b* can detect this and control the switch SW2 so that the differential input voltage Vid2 is transmitted to the second logic circuit 139*b*. On the other hand, if the lock signal Lock normally maintains a high state, the lock output signal Lock(OUT) can be generated according to the output value of the first logic circuit 132*b* by applying the default high signal to the second logic circuit 139*b*.

Accordingly, in a state in which the differential input voltage Vid2 is applied to the second logic circuit 139*b*, if the differential input voltage Vid2 is applied in a normal high level state, the second logic circuit 139*b* can generate a high level lock output signal Lock(OUT) and transmit it to the timing controller 140.

On the other hand, in a state in which the differential input voltage Vid2 is applied to the second logic circuit 139*b*, if the differential input voltage Vid2 is applied at a low level equal to or less than the reference voltage due to a defect such as a short circuit, the second logic circuit 139*b* can generate a low level lock output signal Lock(OUT), thereby blocking the transmission of the digital image data DATA from the timing controller 140 and preventing an abnormal data voltage Vdata from being generated in the second source driving integrated circuit SDIC2.

Meanwhile, in a state in which a default high signal is supplied through the switch SW1 and the lock input signal Lock(IN) provided by the timing controller 140 normally maintains a high level state, data When a failure, such as a short circuit, if a defect such as a short circuit occurs in the signal line transmitting the data packet DP, the output of the clock recovery circuit 131*a* can be maintained at a low level.

Accordingly, since the output signals of the first logic circuit 132*a* and the second logic circuit 139*a* are maintained at a low level, it is possible to prevent the abnormal data voltage Vdata from being generated in the data driving circuit 130 by blocking the transmission of the digital image data DATA from the timing controller 140.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present invention. The above description and the accompanying drawings provide an example of the technical idea of the present invention for illustrative purposes only. For example, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel in which a plurality of data lines and a plurality of subpixels are disposed;

a data driving circuit configured to supply a data voltage to the plurality of data lines; and a timing controller configured to control the data driving circuit and transmit a data packet to the data driving circuit through a point-to-point interface, wherein the data driving circuit is configured to convert digital image data included in the data packet into the data voltage, and wherein the data driving circuit includes a clock recovery circuit configured to generate an internal clock using the data packet and generate a high level lock output signal if a phase of the internal clock is locked, a first logic circuit configured to receive an output of the clock recovery circuit and a lock input signal transmitted from the timing controller, and a second logic circuit configured to receive an output signal of the first logic circuit and a differential input voltage of a signal line through which the data packet is transmitted.

2. The display device of claim 1, wherein the data driving circuit includes a plurality of source driving integrated circuits connected in series, and wherein the lock input signal is sequentially transmitted through the plurality of source driving integrated circuits, and the data packet is transmitted from the timing controller to the plurality of source driving integrated circuits, respectively.

3. The display device of claim 1, wherein the data packet includes:

a clock training pattern for synchronizing the internal clock, a data control signal for controlling the data driving circuit, and the digital image data for displaying an image on the display panel.

4. The display device of claim 3, wherein the data control signal includes low level data not including color information.

5. The display device of claim 1, wherein the lock output signal is a signal indicating whether the phase of the internal clock is locked.

6. The display device of claim 1, wherein the differential input voltage is determined to be a low level if the differential input voltage is less than or equal to a reference voltage.

7. The display device of claim 6, wherein the reference voltage is set by an offset of the second logic circuit.

8. The display device of claim 1, wherein the data driving circuit comprises:

a receiving buffer configured to receive the data packet;

a reception characteristic control circuit configured to control reception characteristics of the receiving buffer;

an unpacker separating the data packet transmitted through the receiving buffer;

a data processing circuit configured to convert the digital image data of a serial structure separated through the unpacker into a parallel structure; and a phase comparison circuit configured to compare the phase of an input clock included in the data packet and a phase of the internal clock.

9. The display device of claim 1, wherein the data driving circuit further comprises:

a counter configured to count a number of transitions of the lock input signal; and a switch configured to transfer the differential input voltage to the second logic circuit according to an output signal of the counter.

10. The display device of claim 1, wherein the timing controller is configured to control the differential input voltage corresponding to a maximum voltage level of the data packet.

11. The display device of claim 1, wherein the timing controller comprises:

a data processing circuit configured to align a clock training pattern, a data control signal and the digital image data into a serial data signal;

a clock generation circuit configured to generate an input clock of the data packet;

a packer configured to embed the input clock in the serial data signal;

a transmission buffer configured to convert the serial data signal input from the packer into the data packet and transmit the data packet; and an output characteristic control circuit configured to control output characteristics of the data packet.

12. A driving circuit comprising:

a clock recovery circuit configured to, through an interface which serializes digital image data and inserts clock information so as to transmit a data packet in a point-to-point manner, generate an internal clock using the data packet received during a display driving period, and generate a high level lock output signal when a phase of the internal clock is locked;

a first logic circuit configured to receive an output of the clock recovery circuit and a lock input signal; and a second logic circuit configured to receive an output signal of the first logic circuit and a differential input voltage of a signal line through which the data packet is transmitted.

13. The driving circuit of claim 12, further comprising a plurality of source driving integrated circuits connected in series, wherein the lock input signal is sequentially transmitted through the plurality of source driving integrated circuits, and the data packet is transmitted from a timing controller to the plurality of source driving integrated circuits, respectively.

14. The driving circuit of claim 12, further comprising:

a receiving buffer configured to receive the data packet;

a reception characteristic control circuit configured to control reception characteristics of the receiving buffer;

an unpacker separating the data packet transmitted through the receiving buffer;

a data processing circuit configured to convert the digital image data of a serial structure separated through the unpacker into a parallel structure; and a phase comparison circuit configured to compare the phase of an input clock included in the data packet and a phase of the internal clock.

15. The driving circuit of claim 12, further comprising:

a counter configured to count the number of transitions of the lock input signal; and a switch configured to transfer the differential input voltage to the second logic circuit according to an output signal of the counter.

* * * * *